US005918393A

United States Patent [19]

Martell

[11] Patent Number: 5,918,393

[45] **Date of Patent: *Jul. 6, 1999**

[54] COLLECTIBLE DISPLAY DEVICE FOR MULTIPLE DISPLAYS

[76] Inventor: Janice J. Martell, 152-18 Union Turnpike—Apartment 2-S, Flushing, N.Y. 11367

[ * ] Notice: This patent is subject to a terminal disclaimer.

[21] Appl. No.: 09/088,177

[22] Filed: Jun. 1, 1998

Related U.S. Application Data

[63] Continuation-in-part of application No. 08/548,907, Oct. 26, 1995, Pat. No. 5,791,075.

[51] Int. Cl.[6] ..... B65D 85/00

[52] U.S. Cl. ..... 40/1; 40/800; 206/315.9; 206/524.8; 206/776

[58] Field of Search ..... 40/1, 410, 660, 40/800; 206/315.9, 524.8, 776; 248/309.1, 314, 324.7

[56] References Cited

U.S. PATENT DOCUMENTS 2,777,233 1/1957 Brandhorst .
3,233,727 2/1966 Wilson .
5,082,110 1/1992 Hager .
5,238,648 8/1993 Kremen .
5,379,892 1/1995 Reams et al. .

*Primary Examiner*—Cassandra H. Davis
*Attorney, Agent, or Firm*—Kenneth P. Glynn, Esq.

[57] ABSTRACT

The present invention is directed to a device for visibly displaying collectable items. It includes: a main support base; a collectable item mount removably attached to and located in said base; a cover adapted to fit over the mount and adapted for connection to the base, the cover being at least partially transparent; a connecting mechanism for attaching the cover to the base; a seal located at an interface between the cover and the base when the cover is connected to the base; at least one evacuation port located on one of the covers and the base; and a one way valve located in the evacuation port which is adapted to permit removal of air from the device and to prevent air from re-entering the device, when the cover is connected to the base. The device may be made to rest on a surface or may, surface mounted, either horizontally or vertically. In one preferred embodiment, the cover connects to the base via threading as the connecting mechanism.

8 Claims, 3 Drawing Sheets

COLLECTIBLE DISPLAY DEVICE FOR MULTIPLE DISPLAYS

REFERENCE TO RELATED CASE

This is a continuation-in-part of U.S. patent application Ser. No. 08/548,907, filed on Oct. 26, 1995 now U.S. Pat. No. 5,791,075, entitled COLLECTABLE DISPLAY DEVICE WITH EVACUATION MEANS, by the same inventor herein, which has been allowed.

BACKGROUND OF THE INVENTION

1. Field of the Invention

The present invention is directed to devices which are used to display collectable items such as autographed baseballs, gems, coins, medals and other collectable items. It is particularly directed to the purpose of preserving such items by including as a critical feature, the ability for a user to evacuate the display device itself. The devices of the present invention may be portable or may be permanently mounted. They may be smaller in size, e.g. to accommodate a diamond or a small coin, or may be larger in size, e.g., to accommodate collectables such as museum objects, rare bones or any other conceivable collectable item. The difference between the present invention and the aforesaid related parent application invention is that the present invention has a base without a lower member of a mount connected thereto. In other words, the present invention has a separate, collectable item mount attached directly to the base and the mount is a single piece instead of a permanently connected lower member and a removable upper member.

2. Information Disclosure Statement

Housings and display cases for collectable items have been in existence for hundreds of years. Clearly, the museums of Rome, Greece and Egypt have used wood and glass display cases for hundreds and perhaps thousands of years. Today, there exist very sophisticated and expensive, permanent encasements which are used by most museums and these include complex electronic sensors, lasers and/or protective gases, as well as other means for preserving the collectable items contained therein.

U.S. Pat. No. 2,777,233 to Alma E. Brandhorst describes a memorial unit comprising a rectangular plate, a pair of vertical L-shape rods connected with the oppositely disposed corners of the plate and extending downwardly, the end of one of the rods extending upwardly of the plate, a rectangular frame formed into L-shape arms and having lips extending inwardly of the frame, the arms being hingedly connected with the upwardly extending end of the one of the rods, whereby the frame is capable of being manually opened and closed, the other ends of the arms being bent at angles and having holes therein, and adapted to contact each other when the frame is in closed position, a padlock having its bar received in the holes to lock the frame in closed position when the pad-lock is in locked position, a rectangular base received between the arms in said frame and being supported by said plate and said lips extending over the base when said frame is in closed position to prevent said base being removed from the frame, and said base having a hole in its upper surface, a vertical tube in the hole and being fixed to the base and extending upwardly therefrom to receive stems of flowers, the walls of the hole in said base being threaded, a transparent globe having a lower open threaded end through which the stems and flowers extend upwardly into the globe, the threaded end of the globe capable of being screwed into the threads of the walls of the hole in the base, and an upwardly extending arm fixed to one of the arms of the frame and being curved inwardly of said base and extending over the top of said globe in close proximity thereto to prevent said globe being removed from said base when the support is in closed position, a receptacle containing the remaining ashes of a deceased person fixed to the rods, and an identification plate fixed to the inner surface of the globe.

U.S. Pat. No. 3,233,727 to Karl H. Wilson describes an object of the invention to provide a multiple use packaging container in which commodities can be kept sealed from the atmosphere under any desired pressure whether positive, negative or atmospheric for any length of time, and after the opening of the container the desired pressure condition can be restored thereby to contain and preserve any desired commodity or commodities having a container formed of material impervious to the flow of air therethrough and open at one end thereof, means for closing the open end of the container, the container having a cap having interlocking means integral therewith and sealing means associated therewith for interlocking and hermetically sealing the cap on the one end of the container, a valve body complementary in size and shape to the counterbored passage mounted snugly therein and extending in exposed relation to both sides of the cap member, split ring means at one side of the cap for securing the valve member in sealed seated position on the conical base of the counterbored passageU.S.

U.S. Pat. No. 5,082,110 to Alan C. Hager describes a protective case provided for tamper-proof, long term presentation and display of a collectible baseball. The case consists of a transparent dome, a baseplate that seals the dome, and a transparent disc that secures a documentation panel to the underside of the baseplate. The dome and baseplate are configured such that the baseball is held therebetween in an immobilized state. With the baseball in place, the dome and baseplate are bonded together, preferably by cohesive bonding techniques such as sonic welding.

U.S. Pat. No. 5,238,648 to Irwin Kremen describes a hermetic enclosure assembly, having utility for preservational storage and/or display of objects susceptible to degradation by exposure conditions such as ultraviolet radiation, visible light, oxygen, humidity, microbial, fungal, and insect species, internal acidity and external acidic gases, and the like. The enclosure assembly includes a gas-impervious housing, a mounting base, and a back cover plate, with an oxygen indicating means in communication with an interior volume of the enclosure assembly, and a slow vapor-released deacidification medium being arranged for dispersing deacidification medium vapor into the interior volume of the enclosure assembly. Also disclosed is an appertaining method of preservationally and protectively enclosing an object for storage and/or display. The invention has particular utility in the storage and/or display of cellulosic objects, which are especially susceptible to embrittlement and decay at low Ph conditions, in exposure to visible light, oxygen and moisture.

U.S. Pat. No. 5,379,892 to William H. Reams describes a holder to protect and display baseballs and other collectible items. It comprises a rigid transparent tube which contains the baseballs and through which they can be viewed, one end cap at each end of the transparent tube to retain the balls, a rigid backboard to which the end caps are attached for the purpose of holding the end caps in their fixed rigid position.

Notwithstanding the above, it is believed that there does not exist any collectable item display device utilizing the portability, simplicity and evacuation capabilities of the present invention devices which would render the present invention devices obvious or unpatentable.

SUMMARY OF THE INVENTION

The present invention is directed to a device for visibly displaying collectable items. It includes: a main support base; a collectable item mount removably attached to and located in said base; a cover adapted to fit over the mount and adapted for connection to the base, the cover being at least partially transparent; a connecting mechanism for attaching the cover to the base; a seal located at an interface between the cover and the base when the cover is connected to the base; at least one evacuation port located on one of the covers and the base; and a one way valve located in the evacuation port which is adapted to permit removal of air from the device and to prevent air from re-entering the device, when the cover is connected to the base. The device may be made to rest on a surface or may, surface mounted, either horizontally or vertically. In one preferred embodiment, the cover connects to the base via threading as the connecting mechanism.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 2:
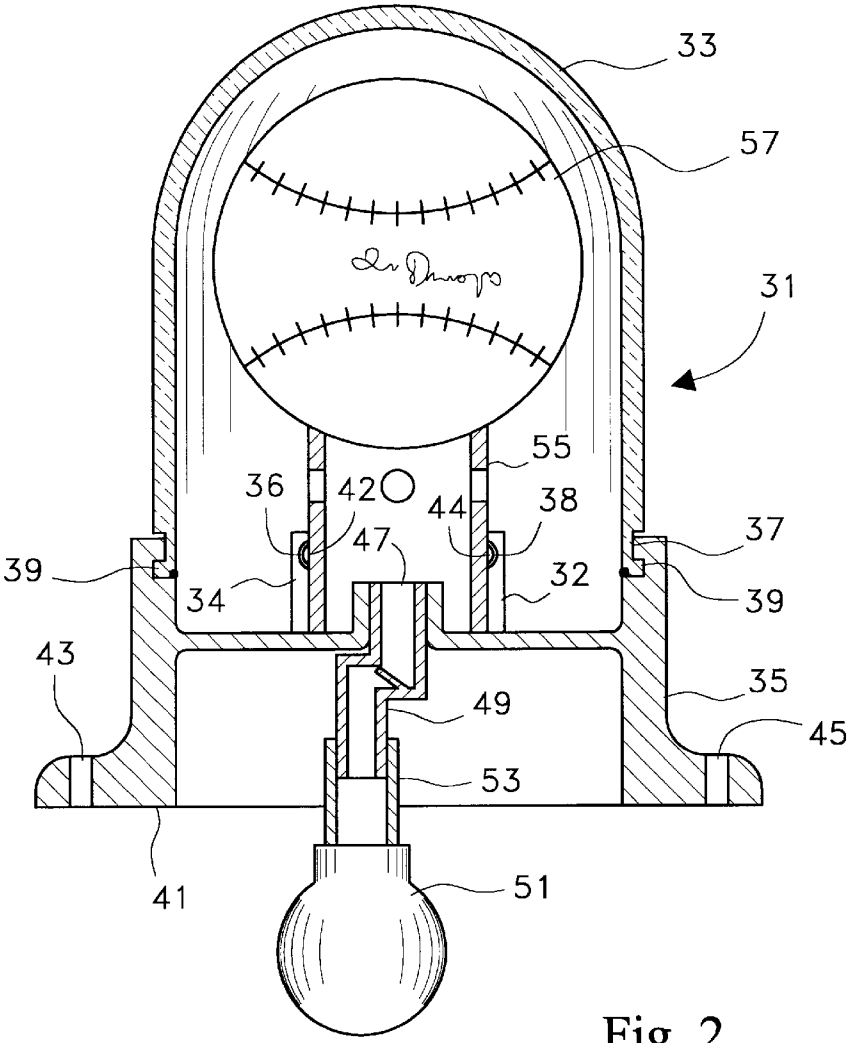
FIG. 2 shows an alternative embodiment present invention device with an autographed baseball and including evacuation means contained therein.

As mentioned above, the present invention involves a display device for collectable items. Most significantly, the present invention is directed to such display devices which are easy to use and portable and which include the ability for a user to place his or her own collectable item within the device, seal the device and readily evacuate the device to remove air therefrom, so as to prevent oxidation and deterioration of the collectable item. Thus, the present invention device may be used to store any type of collectable item desired from very small items, such as gems and small coins, to very large items, such as meteors, fossils, rare artifacts and the like.

The present invention device includes a main support base and this may be made of metal, plastic, wood, stone, cast materials such as ceramic or even concrete or any other solid material. The support base may be flat or have legs or paws for resting on a horizontal surface, may be adapted to be attached to a vertical surface or may otherwise be formed within the scope of the invention. That is, the base could even have a semi-circular shape and still act as a base in a present invention embodiment. It could even take on other shapes to that it would be adapted to nest into some type of irregular nesting member, e.g. a tripod support.

The support base includes an attachment means adapted for attachment of a removable collectable item mount thereto. The attachment means may be one or more clips, a screw-in hole, springy type rods with protrusions to correspond to in-cuts of the mount, conversely, with recesses on the rods to receive protrusions from the mounts. Alternatively, these attachment means may be force fit snap-ins or spring loaded clamps. They may be any other means which are within the skill of one of ordinary skill in the art which would permit attachment of a mount, such as a vertical mount, to a base.

The present invention device also includes a collectable item mount which is to be removably located on the base. This may be a portable mount which, as mentioned, may be screwed, glued or otherwise affixed to the base. The critical aspect of the mount is that it holds a collectable item and may be removably attached to the base.

The present invention device also includes a cover. This cover may be glass or plastic or a combination of any of the materials made out of the base with some sort of a glass or plastic window included therein. Thus, the cover of the present invention device is at least partially transparent, although it may be fully transparent. While the drawings discussed below show domed embodiments of the cover, this cover could be box like, rectangular, hexangular or any other shape desired. One important feature in some preferred embodiments of the present invention is the use of an ultraviolet light inhibitor for the transparent portion of the cover. This inhibitor may be blended into the plastic resin or may be a separate film or coating.

The cover is adapted to attached to the base and that adaptation must be of a complimentary type. That is, in some fashion, the cover and the base must fit into one another such as where either the cover or the base has a protruding male insertable aspect and the other of the two has the receiving, female aspect. Typical connecting mechanisms can include snap downs such as are used in suitcases, threading, snap fits or any other mechanism including screw downs. In the area located between the cover and the base must be a seal. This seal may be a separate element and may be formed of materials of construction other than those of the base and cover, such as rubber ring seal, or in those cases where the compatibility of the base and the cover are such that when they are force fitted together they inherently form a seal between them, then the receiving or connecting portions of the base cover themselves create and become the sealing means. In general, however, the base may be made of wood or plastic or other material and the dome will be made of glass or plastic and a rubber seal would be appropriate. Alternative types of seal means would be types of glues, flexible plastic materials and the like. The ability to seal a space between glass or glass and other material, such as wood and plastic is well known and the artisan could develop other mechanisms without exceeding the scope of the present invention.

Another feature of the present invention involves the evacuation aspect. Thus, either the cover or the base includes an evacuation port and a one way valve. The valve may be a flat valve, a seat valve, a bulb valve or any other type of valve. In fact, any valve available which operates to allow evacuation and prevents re-entry of air could be used. The valve may be fitted into the evacuation port and would typically have some mechanism for attachment to the evacuation means. This can include adaptations to a vacuum cleaner, or more simply, adaptations to a bulb type evacuation mechanism such as described in conjunction with the drawings below.

Figure 1:
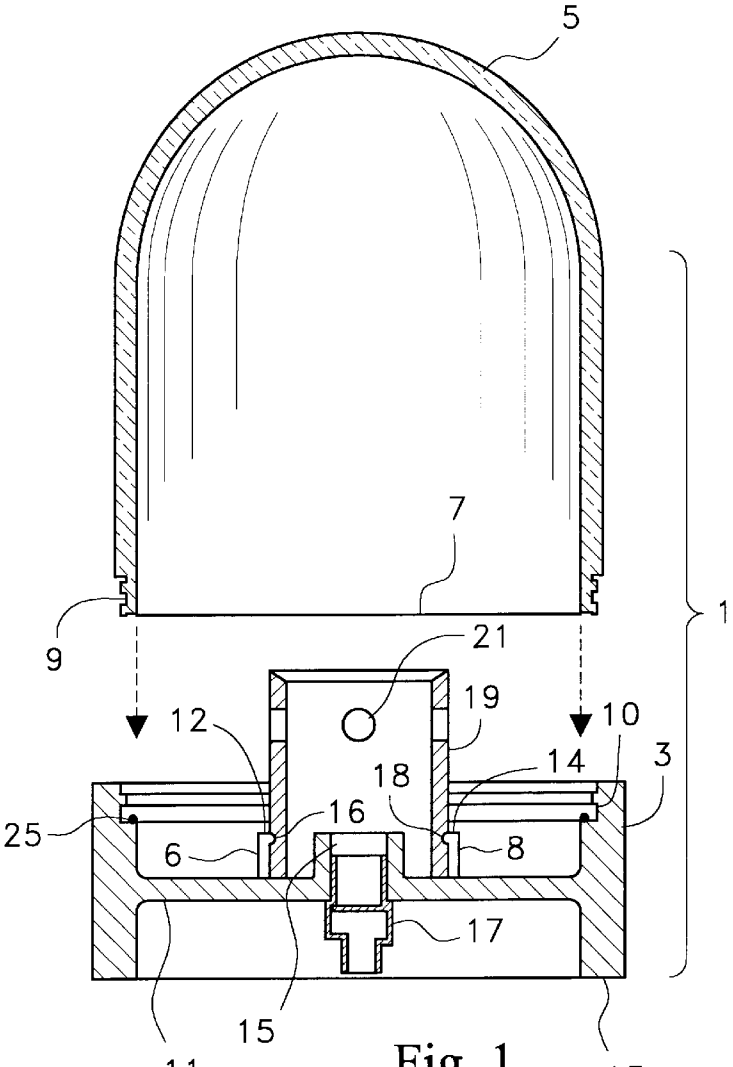
FIG. 1 shows a front cut view of a present invention embodiment using a dome cover.

Referring now to FIG. 1, there is shown a front cut view of a present invention device 1, which includes a base 3 and a cover 5. Base 3 and cover 5 include attachment means, i.e. threads, such as threads 9 and 10. At the base of threads 9 and 10 is a seal means to permit depressurization (evacuation) of the device when the base 3 and cover 5 are connected. Here, the seal means is a circular rubber gasket 25, which is comprised when cover 5, at its bottom 7, is fully threaded downwardly onto base 3 at threads 10.

Base 3 has attachment means adapted to receive mount 19 and this mount 19 includes evacuation holes such as hole 21.

In this embodiment, base bottom 11 has two upright prongs 6 and 8 having protrusions 12 and 14, respectively. Protrusions 12 and 14 fit into notches 16 and 18 shown on the side wall of mount 19. Thus, mount 19 is simply snapped into place and due to the flexibility of upright prongs 6 and 8, mount 19 may be removed by pulling upwardly. Base 3 has an evacuation port 15 which is raised above the lowest portion via circular leg 13. Port 15 has permanently inserted therein a one way flap valve 17, which permits removal of air therefrom and prevents return of air therein, when cover 5 and base 3 are sealably connected and device 1 is evacuated through valve 17 and port 15.

A user would place a collectable on mount 19, screw transparent cover 5 onto wood base 3 tightly, and evacuate to remove air and decrease or inhibit corrosion, oxidation or tarnishing of the collectable.

FIG. 2 shows a front cut view of alternative embodiment present invention device 31, with cover 33 and base 35. Snap fit component such as snap fit component 37 is included, along with a seal 39. Base 35 has a spread, hollow bottom 41, with anchor screw holes 43 and 45. Base 35 includes four rods, two of which are shown as rods 32 and 34 with recesses 36 and 38. These are adapted to receive protrusions 42 and 44 of collectable item mount 55. Mount 55 surrounds evacuation port 47 and holds an autographed baseball 57. Evacuation port 47 has a one way valve 49 and has temporarily attached thereto a bulb 51 with attachment stem 53. The bulb 51 is simply squeezed and released repeatedly to achieve useful, partial evacuation. Other evacuation means could be used, e.g. a hose and pump, a vacuum cleaner adapter, or any other known evacuation means.

Figure 3:
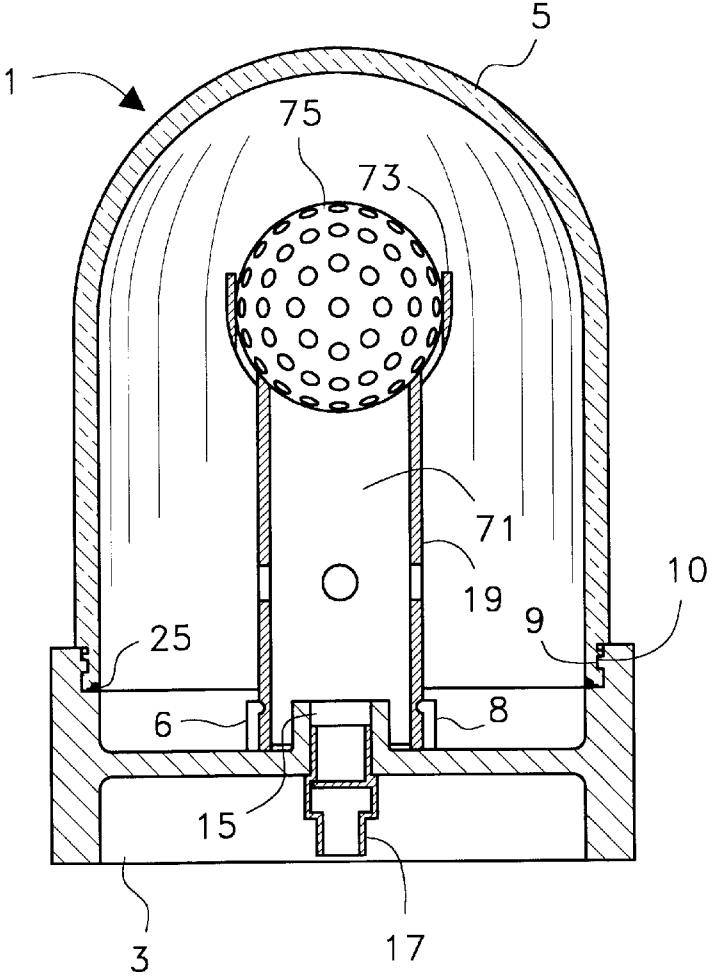
FIG. 3 shows a cut front view of the device shown in FIG. 1 but in its assembled form, and with an auxiliary mount unit and with a hole in one golf ball contained therein.

FIG. 3 shows a cut view of device 1 of FIG. 1, but in its closed, sealed state, and with an auxiliary mount and collectable contained therein. Thus, all parts identical to those shown in FIG. 1 are identically numbered and need not be repeated. Mount 19 has been designed as a sleeve to receive a plurality of upper members, such as upper member 71, which is specifically designed to slide into (lower member) mount 19 and to hold a golf ball at semi-spherical top 73, such as golf ball 75.

Figure 4:
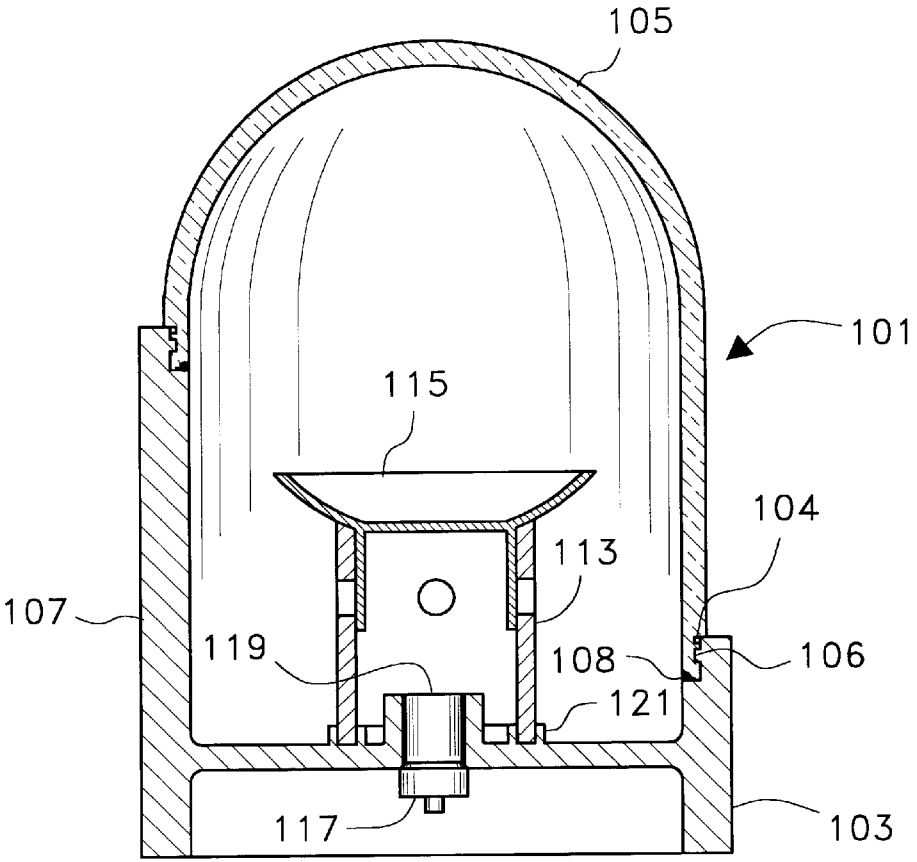
FIG. 4 shows a side cut view of a present invention device which is adapted to be utilized on a horizontal surface for display or to be permanently attached to a vertical surface such as a wall, and, FIG. 5 shows a front view thereof with a collectable item on display.

FIG. 4 shows another alternative embodiment present invention device 101, in a side, cut view, having a base 103, snap fit components 104 and 106, cover 105, seal 108 and mount 113. Base 103 has a back 107 adapted for vertical mounting. One way valve 117 is located in evacuation port 119 and is operated as described above. There is also a two-piece collectable item mount. This mount has an upper member 115 which slides into vertical, lower member 113 and this is interchangeable with other slide-in upper member mounts as shown in the Figure. The bottom of lower member 113 is force fitted into annular ring 121. Annular ring 121 is, in this embodiment, unistructurally formed with base 103. As an alternative to annular ring 121, there may be a recessed circular groove in base 103 which is adapted for force fitting or snap-in of lower member 113 on the collectable item mount.

Figure 5:
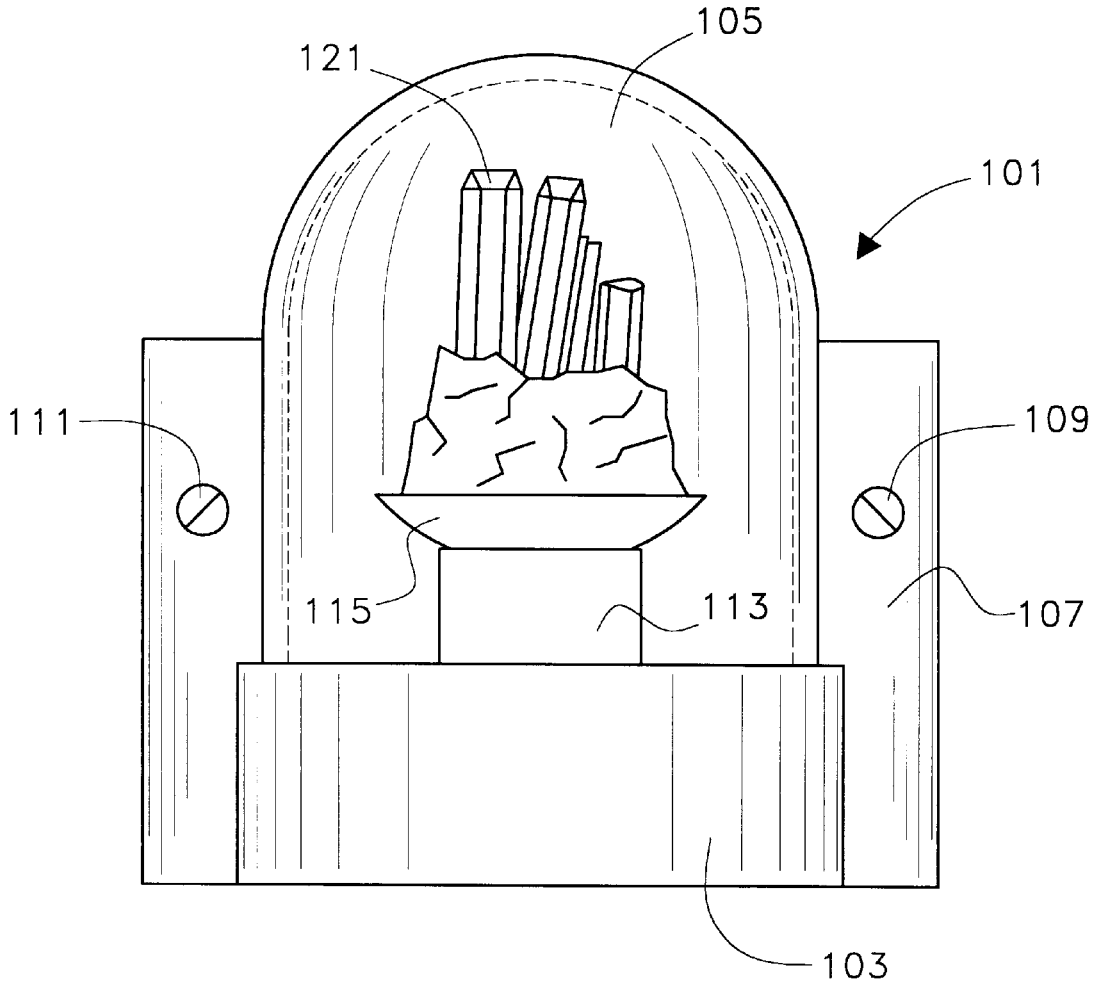

FIG. 5 shows a full front view of device 101 shown in FIG. 4, with identical parts identically numbered. Screws 109 and 111 are used to mount device 101 vertically, e.g. on a wall. Upper member 115 of the mount may be used to mount a baseball or other object, a medal or large commemorative coin or even a rock and crystals such as item 121 shown.

Obviously, numerous modifications and variations of the present invention are possible in light of the above teachings. It is therefore understood that within the scope of the appended claims, the invention may be practiced otherwise than as specifically described herein.

What is claimed is:

1. A device for visibly displaying collectable items, which comprises:

(a) a main support base;

(b) a separate, collectable item mount located in said base, said mount including means for removably attaching said mount to said base;

(c) a cover adapted to fit over said mount and adapted for connection to said base, said cover being at least partially transparent;

(d) connecting means for attaching said cover to said base;

(e) seal means located at an interface between said cover and said base when said cover is connected to said base;

(f) at least one evacuation port located on said base; and, (g) a one way valve located in at least one evacuation port adapted to permit removal of air from said device and to prevent air from re-entering said device, when said cover is connected to said base.

2. The device of claim 1, wherein said support base is flat and adapted to rest on a horizontal surface.

3. The device of claim 1, wherein said device further includes securing means connected to said base and adapted to secure said base to a flat surface.

4. The device of claim 1, wherein said base includes attachment means which is adapted to be attached to a vertical surface.

5. The device of claim 1, wherein said connecting means is threading on said cover and said base.

6. The device of claim 1, wherein said mount is permanently connected to said base.

7. The device of claim 1, wherein said mount is a vertical hollow tubular member adapted to mount a spherical collectable item.

8. The device of claim 1, wherein said one way valve includes a valve stem adapted to receive an evacuation pump.

* * * * *